US005578784A

United States Patent [19]

Karr et al.

[11] Patent Number: 5,578,784

[45] Date of Patent: Nov. 26, 1996

[54] PROJECTILE STOPPING SYSTEM

[75] Inventors: Thomas J. Karr, Alamo; Lee C. Pittenger, Livermore, both of Calif.

[73] Assignee: The Regents of the University of California, Oakland, Calif.

[21] Appl. No.: 595,442

[22] Filed: Feb. 5, 1996

[51] Int. Cl.[6] ..... F41H 5/007; F41H 5/16

[52] U.S. Cl. ..... 89/36.03; 89/36.17

[58] Field of Search ..... 89/36.17, 36.05, 89/36.03; 109/49.5, 36

[56] References Cited

U.S. PATENT DOCUMENTS

| | | | |
|---|---|---|---|
| 3,943,870 | 3/1976 | Paslay | 89/36.17 |
| 4,051,763 | 10/1977 | Thomanek | 89/36.17 |
| 4,262,595 | 4/1981 | Longerich | 89/36.17 |

FOREIGN PATENT DOCUMENTS

| | | | |
|---|---|---|---|
| 2304051 | 10/1976 | France | 89/36.03 |
| 1185090 | 1/1965 | Germany | 89/36.03 |
| 2700132 | 7/1978 | Germany | 89/36.03 |

*Primary Examiner*—Stephen M. Johnson
*Attorney, Agent, or Firm*—Henry P. Sartorio

[57] ABSTRACT

A projectile interceptor launches a projectile catcher into the path of a projectile. In one embodiment, signals indicative of the path of a projectile are received by the projectile interceptor. A flinger mechanism has a projectile catcher releasably attached thereto, such that the projectile catcher can be released and launched from the flinger mechanism. A controller connected to the flinger mechanism uses the signals indicative of the path of the projectile to determine the launch parameters of the projectile catcher. The controller directs the flinger mechanism to release the projectile catcher such that the projectile catcher is launched into the path of the projectile and intercepts the projectile.

20 Claims, 9 Drawing Sheets

PROJECTILE STOPPING SYSTEM

The United States Government has rights in this invention pursuant to Contract No. W-7405-ENG-48 between the United States Department of Energy and the University of California, for the operation of Lawrence Livermore National Laboratory.

BACKGROUND OF THE INVENTION

1. Field of the Invention

The present invention relates to intercepting a projectile. Specifically, the present invention relates to stopping a bullet.

2. Description of Related Art

Unfortunately, in today's society certain people are at risk of being shot when in public. Such people include heads of state, dignitaries, celebrities, and the like. Tragedies such as the assassination of Prime Minister Rabin, the assassination of Anwar Sadat, and the attempted assassination of Pope John Paul II, serve as reminders of the risks faced by those in the public eye.

During a shooting or attempted assassination, the targeted victim is often not struck or killed by the first shot. In some instances, such as, for example, the Kennedy assassination, the victim is not aware of the attack until several shots have been fired. Therefore, in such instances, several seconds may pass before evasive action is taken by the targeted victim or by bodyguards for the targeted victim. Furthermore, even when the attack is noticed immediately, it may still take several seconds for the targeted victim or for the targeted victim's bodyguards to take evasive action.

In an attempt to protect potential victims, safety devices such as bulletproof vests, and bulletproof glass or armor plated enclosures have been employed. However such devices are often impractical and/or ineffective. For example, a dignitary may not want to be separated from an audience by an enclosure of bulletproof glass or armor plating. Furthermore, even when wearing bulletproof clothing, a portion of the potential victim's body is still exposed to a potential assassin.

Thus, a need exists for a system which protects a targeted shooting victim even when the victim is not yet aware of the attack, a system which does not require enclosing the victim in a bullet proof enclosure, and a system which protects the entire body of a targeted victim.

DISCLOSURE OF THE INVENTION

It is therefore an object of the present invention to provide a system which protects a targeted shooting victim even when the victim is not yet aware of the attack, a system which does not require enclosing the victim in a bullet proof enclosure, and a system which protects the entire body of a targeted victim. The above object is achieved with a projectile intercepting device wherein a flinger mechanism launches a projectile catcher into the path of an incoming projectile.

A projectile interceptor is disclosed. Specifically, in one embodiment, signals indicative of the path of a projectile are received by the projectile interceptor. A flinger mechanism has a projectile catcher releasably attached thereto, such that the projectile catcher can be released and launched from the flinger mechanism. A controller connected to the flinger mechanism uses the signals indicative of the path of the projectile to determine the launch parameters of the projectile catcher. The controller directs the flinger mechanism to release the projectile catcher such that the projectile catcher is launched into the path of the projectile and intercepts the projectile.

In another embodiment, the flinger mechanism is further comprised of a rotator which has the projectile catcher attached thereto. The rotator is spinning such that the projectile catcher is launched outwardly from the flinger once the projectile catcher is released therefrom. Additionally, in the present embodiment, a light sensor is disposed on the rotator. The light sensor causes the projectile catcher to be released from the rotator when the light sensor is activated.

In yet another embodiment, the projectile interceptor includes a snubber line which is coupled to the flinger mechanism. The snubber line restricts the distance traveled by the projectile catcher after the projectile catcher is launched from the flinger.

A method and system for intercepting a projectile in accordance with the above described apparatus is also disclosed.

BRIEF DESCRIPTION OF THE DRAWINGS

The accompanying drawings, which are incorporated in and form a part of this specification, illustrate embodiments of the invention and, together with the description, serve to explain the principles of the invention.

BEST MODE FOR CARRYING OUT THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
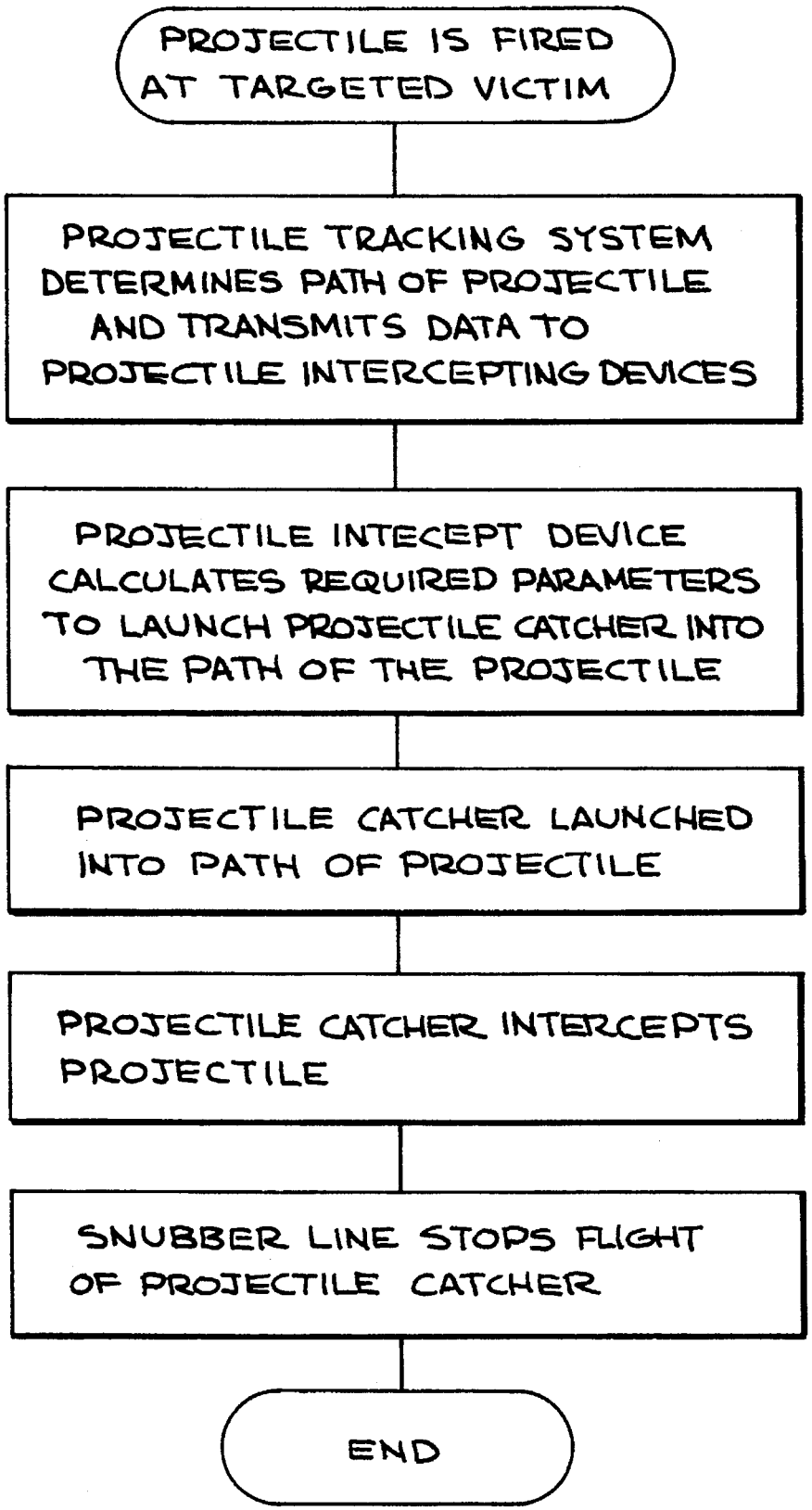
FIG. 1 is a schematic diagram describing an implementation of the present projectile interceptor in accordance with the present invention.

With reference now to FIG. 1, a schematic diagram describing an implementation of the present invention is shown. The present detailed description begins with a brief discussion of the steps shown in FIG. 1, and an overview of the present projectile device in operation. The present detailed discussion then continues with a detailed discussion of the projectile intercepting device of the present invention. As shown in step 10 of FIG. 1, use of the present invention is triggered once a projectile is fired at a targeted victim. In step 12, a projectile tracking system is focused into a region through which a projectile might possibly pass. Once the projectile tracking system detects a projectile, the projectile tracking system determines the path of the projectile. The path of the projectile is transmitted to the present projectile intercepting device which is located near the targeted victim.

The present invention is well suited to being used with any of numerous projectile tracking and path determining systems. Such systems include, but are not limited to, acoustic projectile tracking systems, optical projectile tracking systems, radar, and other active tracking systems. As one example, the present invention is well suited to being used with the projectile tracking system described in co-pending U.S. patent application Ser. No. 08/241,907 to Thomas J. Karr, filed May 12, 1994, entitled Passive Infrared Bullet Detection And Tracking, which is incorporated herein as background material.

In step 14, the present projectile intercepting device calculates the launch parameters needed to launch a projectile catcher into the path of the incoming projectile. As shown is step 16, once launched, the projectile catcher intercepts the incoming projectile thereby protecting the targeted victim from the projectile. In one embodiment, the flight path of the launched projectile catcher is limited using a snubber line attached to the projectile catcher, as recited in step 18.

In the present embodiment, the projectile is a bullet. It will be understood, however, that the present invention is also well suited to intercepting other types projectiles directed at a targeted victim. Other types of projectiles which can be intercepted by the present invention include, but are not limited to, tightly packed shotgun blasts, small mortar projectiles, objects which are thrown at the targeted victim, and the like. Likewise, the present invention is also well suited to protecting items other than targeted victims. For example, the present invention is well suited to protecting an object of value such as a displayed piece of artwork and the like. Furthermore, the projectile intercepting device of the present embodiment is also well suited to protecting a specific geographic area.

Figure 2:
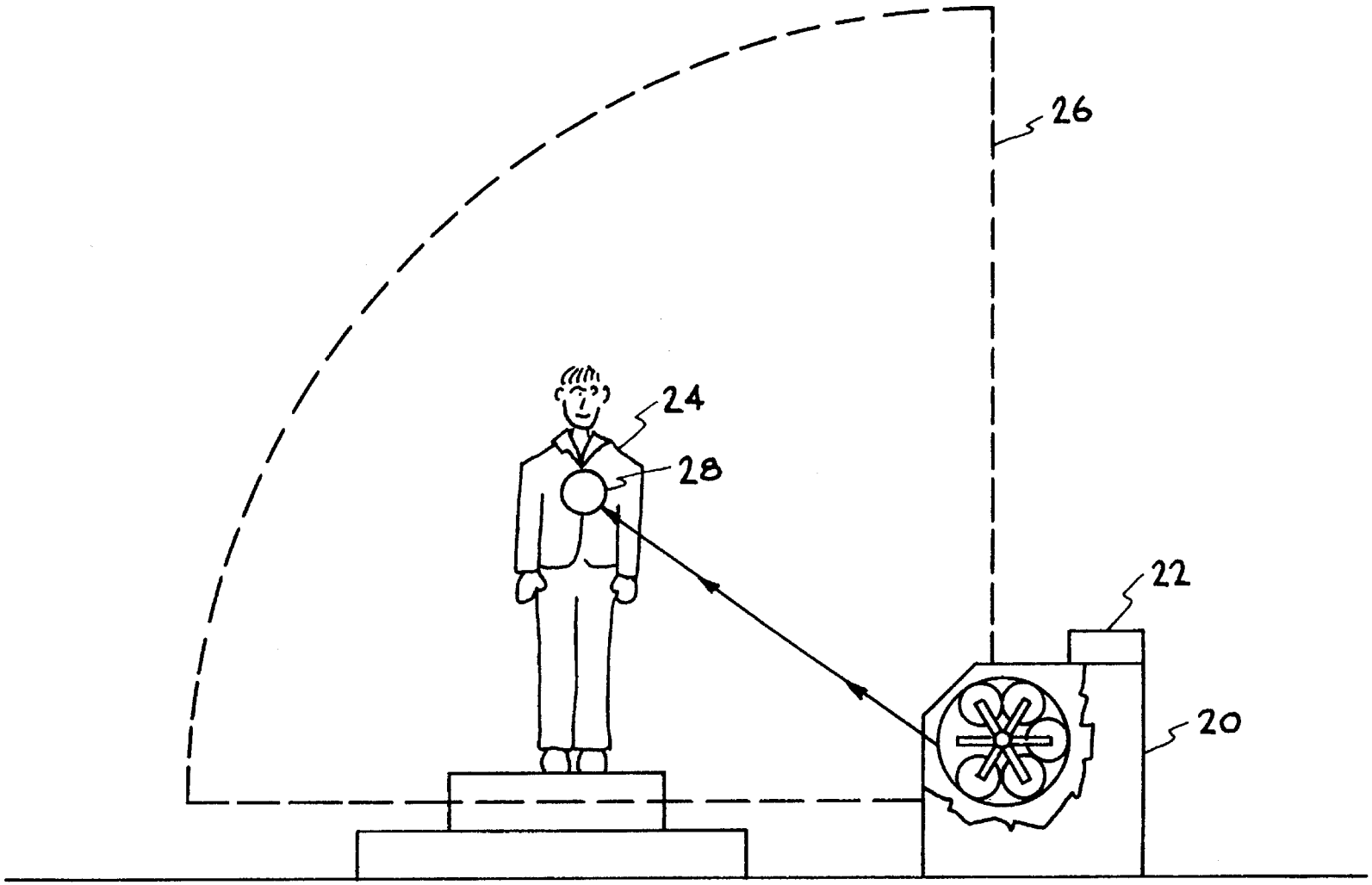
FIG. 2 is a front view of a projectile interceptor illustrating a plane of protection provided in accordance with the present invention.

With reference next to FIG. 2, a diagram illustrating protection provided by the present invention is shown. The present projectile intercepting device 20 and a projectile tracking system 22 are positioned near a potential victim 24. In the embodiment of FIG. 2, potential victim 24 is, for example, addressing an audience. While addressing the audience, the front of potential victim 24 is exposed to a projectile such as, for example, a sniper's bullet. However, the present projectile intercepting device 20 provides a plane of protection 26 which covers the front of potential victim 24. Specifically, projectile intercepting device 20 launches a projectile catcher 28 which flies along plane 26 to the point where an incoming projectile will intersect plane 26. Projectile catcher 28 intercepts the incoming projectile thereby protecting potential victim 24.

In the present embodiment, the point at which the incoming projectile intersects plane 26, as determined by projectile tracking system 22, is reported as a location with respect to the present projectile intercepting device. That is, in the present embodiment, the precise location and orientation of projectile intercepting device 20 is stored within memory of projectile tracking system 22. Once projectile tracking system 22 determines the path of an incoming projectile, projectile tracking system 22 reports to projectile intercepting device 20 the point at which the incoming projectile will intersect plane 26. In addition to reporting the location at which the incoming projectile will intersect plane 26, position tracking system 22 must also report the exact time at which the incoming projectile will intersect plane 26. The present projectile intercepting device 20, uses the reported location and time of intersection to determine the launch parameters for projectile catcher 28. The launch parameters are selected to such that projectile catcher 28 arrives at the point of intersection at the same time the incoming projectile arrives at the point of intersection. In so doing, projectile catcher 28 intercepts the incoming projectile. Thus, as shown in FIG. 2, instead of striking targeted victim 24, the incoming projectile strikes projectile catcher 28. Although projectile tracking system 22 and the present projectile intercepting device 20 are located closely together in the present embodiment, the present invention is also well suited to having projectile tracking system 22 located distantly from projectile intercepting device 20. It will be understood that multiple projectile intercepting devices can be employed to provide protection for a targeted victim on multiple sides. That is, by positioning multiple projectile intercepting devices around a targeted victim, the targeted victim is surrounded on each side by a protective plane.

Figure 3:
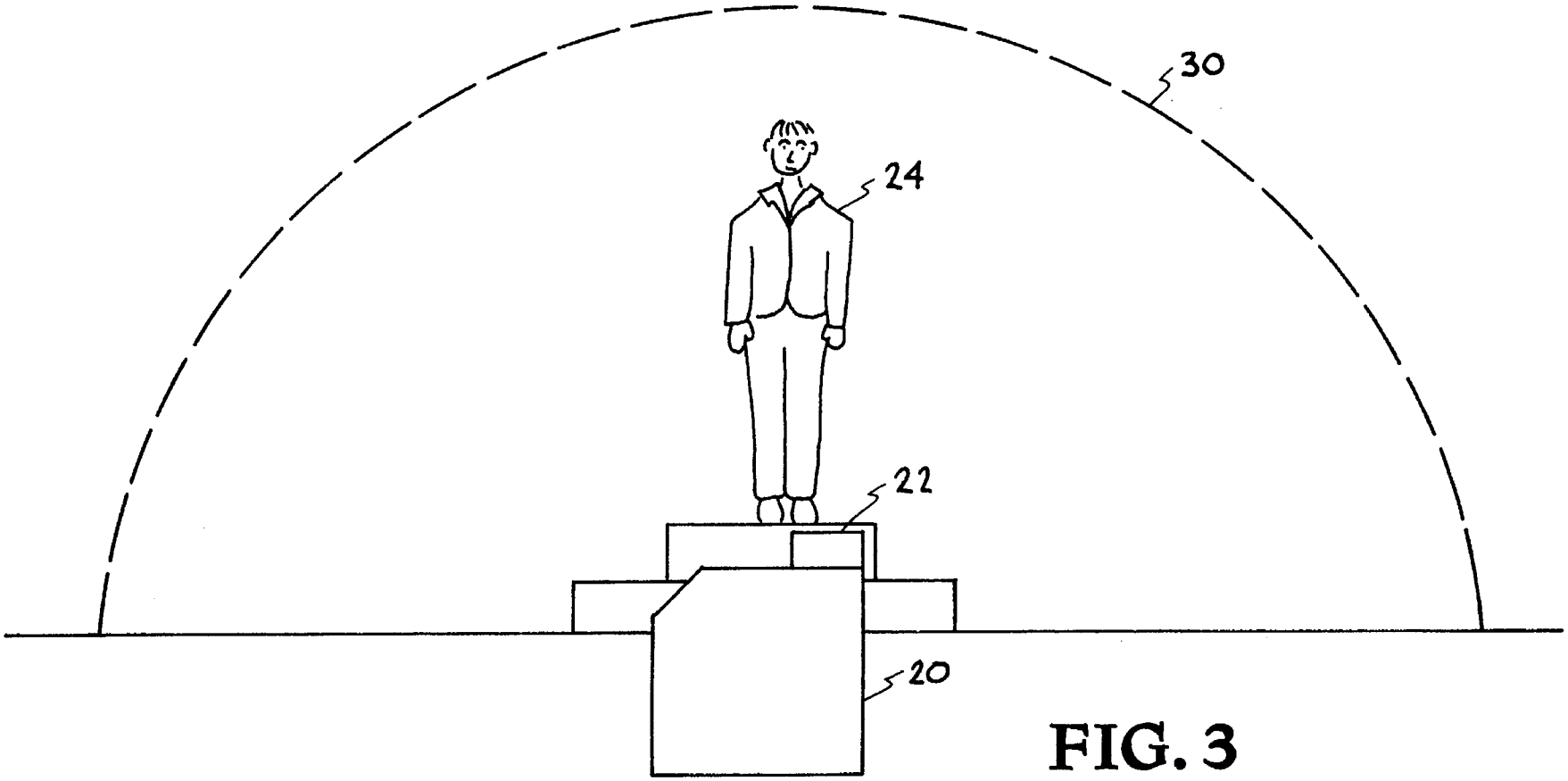
FIG. 3 is a front view of a projectile interceptor illustrating a plane of protection sweeping over 180 degrees in accordance with the present invention.

In the embodiment of FIG. 2, plane of protection 26 sweeps over 90 degrees. Although such a sweep angle is shown in the present embodiment, the present invention is also well suited to differently sized sweep angle. As an example, FIG. 3 shows a plane of protection 30 provided when the present invention sweeps over 180 degrees. It will be understood by those in the art that the sweep angle for the present invention can be selected as desired.

Figure 4:
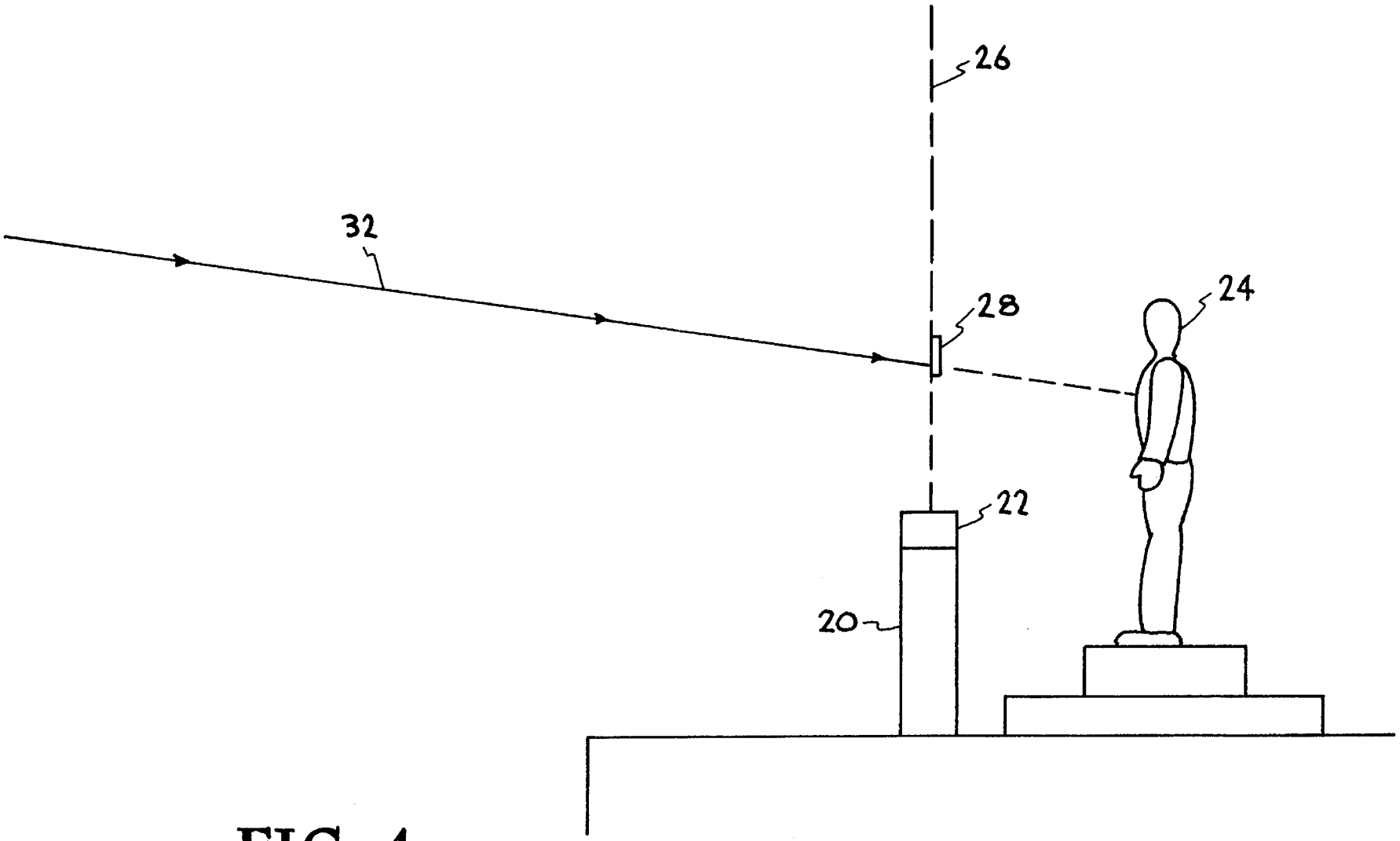
FIG. 4 is a side view illustrating protection provided in accordance with the present invention.

With reference next to FIG. 4, a side view illustrating protection provided by the present invention is shown. In FIG. 4, the path 32 of the incoming projectile is shown intersecting plane 26. At the point of intersection, projectile catcher 28 intercepts the incoming projectile. By intercepting the incoming projectile, the present projectile intercepting device 20 prevents targeted victim 24 from being struck by the incoming projectile.

Figure 5:
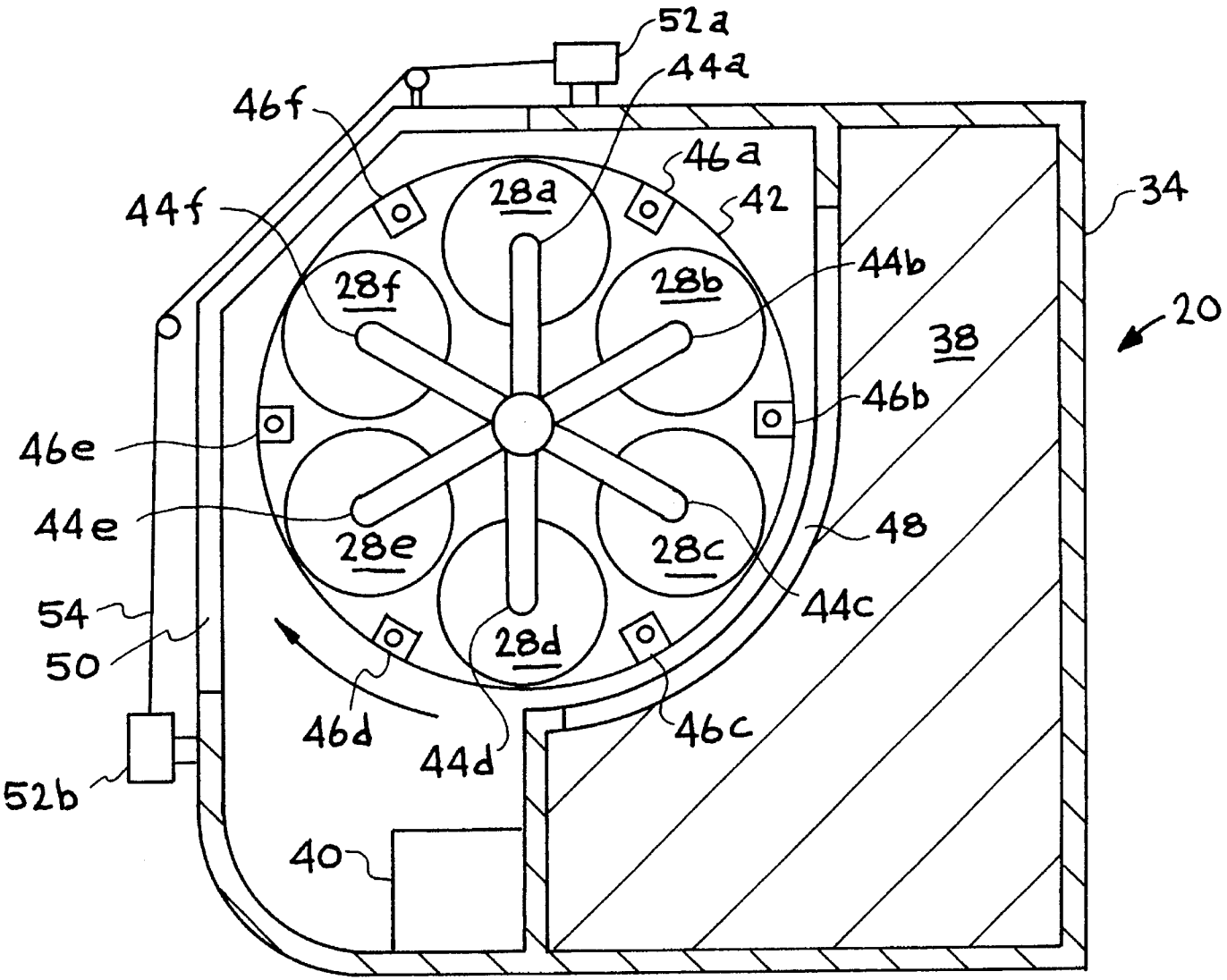
FIG. 5 is a side cut-away view of a projectile intercepting device in accordance with the present invention.

With reference now to FIG. 5, a cut-away view of the present projectile intercepting device is shown. In the present embodiment, the present projectile intercepting device 20 is comprised of a housing 34 enclosing a flinger mechanism 34, a dump zone 38, and a controller 40. Flinger mechanism 34 is further comprised of a rotator 42 having sets of opposing fingers 44*a*–44*f* attached thereto (one of the opposing fingers of each set is hidden in FIG. 5). Each set 44*a*–44*f* of opposing fingers retains a respective projectile catcher, typically shown as 28*a*–28*f* therebetween. In the present embodiment, six projectile catchers 28*a*–28*f* are disposed above rotator 42, and six additional projectile catchers, hidden, reside under rotator 42. It will be understood that the present invention is also well suited to the use of a different number of projectile catchers.

In the present embodiment, each of the sets of opposing fingers has a respective light sensor, typically shown as 46*a*–46*f*, associated therewith. Light sources, not shown, are disposed within housing 34 along an arc. The arc along which the light sensors are disposed is parallel to the arc made by light sensors 46*a*–46*f* when rotator 42 is rotated. In so doing, the light sources are able to selectively shine on any of light sensors 46*a*–46*f*. A second set of opposing fingers, projectile catchers, light sensors, and light sources, resides under rotator 42, and is thus hidden in FIG. 5.

The present projectile intercepting device further includes a dump zone slot 48 and an exit slot 50 formed in housing 34. Spools 52*a* and 52*b* mounted to housing 34 dispense snubber line along exit slot 50. In the present embodiment, snubber line 54 is a monofilament line which is easily released from spools 52*a* and 52*b*. Snubber line 54, of the present embodiment, is further selected to have yield characteristics which minimize springback. A second set spools and snubber line is hidden behind spools 52*a* and 52*b* and snubber line 54 in the present embodiment. Although only two sets of snubber line spools are mentioned in conjunction with the present embodiment, the present invention is also well suited to the use of more than two sets of snubber line spools.

Figure 6:
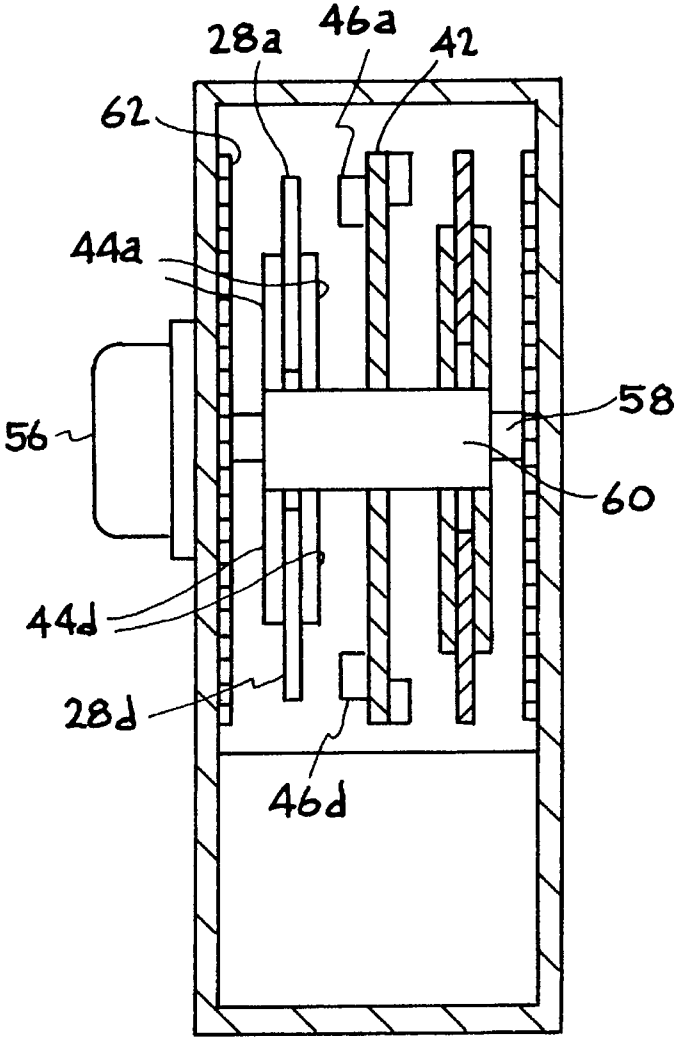
FIG. 6 is a front cut-away view of a projectile intercepting device in accordance with the present invention.

With reference next to FIG. 6, a front cut-away view of projectile intercepting device 20 is shown. As shown in FIG. 6, a motor 56 is connected to a shaft 58 and a hub 60. Rotator 42 and both sets of opposing fingers are coupled to hub 60. Therefore, when motor 56 rotates shaft 58, hub 60, rotator 42, and the attached sets of opposing fingers are also rotated. In the present embodiment, motor 56 causes shaft 58, hub 60, rotator 42, and the attached sets of opposing fingers to rotate at a constant speed of approximately 3370 rpm. Although such a rotational speed is specified in the present embodiment, it will be understood by those of ordinary skill in the art that the present invention is also well suited to operating at various other rotational speeds. As an example, a larger plane of protection is provided by having a higher speed of rotation, and a smaller plane of protection is provided by having a slower speed of rotation. Furthermore, by increasing the speed of rotation it is possible to have the present projectile intercepting device located farther from the targeted victim.

With reference still to FIG. 6, an arc shaped array of light sources, typically shown as 62, resides within housing 34 of the present invention. An array of light sources 62 is disposed along an arc parallel to the arc made by light sensors 46*a*–46*f* when rotator 42 is rotated. In so doing, the array of light sources 62 is able to selectively shine on any of light sensors 46*a*–46*f*. In the present embodiment, the array of light sources 62 is comprised of an array of laser diodes. The light sensors 46*a*–46*f* of the present embodiment are comprised of photocells. Once photocells 46*a*–46*f* are activated, a respective set of opposing fingers are caused to spring apart and release a projectile catcher. The present invention is also well suited to the use of other light sources, such as, for example, LEDs, and the like. Only one set of the opposing fingers, projectile catchers, light sensors, and light sources are labeled in FIG. 6, for purposes of clarity. Thus in the present invention, only rotator 42 moves. By eliminating the need for other moving parts, a further degree of reliability is added to the present invention. Likewise, no electrical connection is required between light sensors 46*a*–46*f* and photocells 46*a*–46*f*. Again, by eliminating the need for other electrical connections, a further degree of reliability is added to the present invention. Although light sensors and LEDs are used in the present embodiment, the present invention is also well suited to the use of other activation means such as, for example, electrical signals, mechanical connections, and the like.

Figure 7:
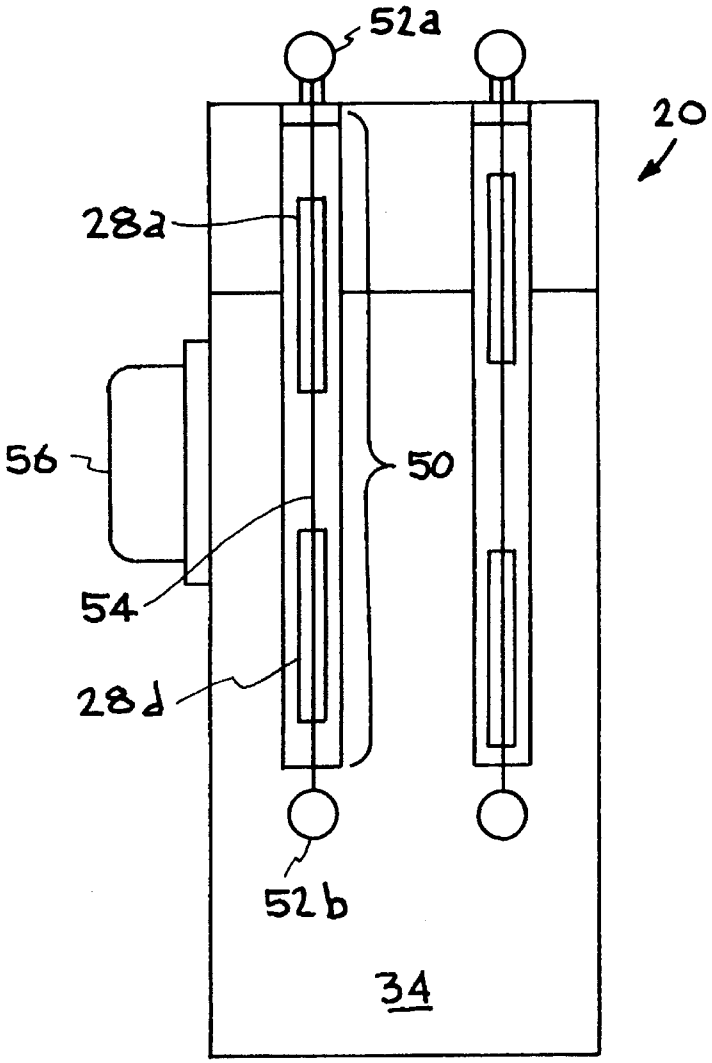
FIG. 7 is a front view of a projectile intercepting device illustrating the orientation of projectile catchers, spools, and monofilament line, with respect to an exit slot in accordance with the present invention.

With reference next to FIG. 7, a simplified diagram illustrating the orientation of projectile catchers 28*a* and 28*d*, spools 52*a* and 52*b*, and monofilament line 54, with respect to exit slot 50 is shown. As shown in FIG. 7, projectile catchers 28*a* and 28*d* are aligned with exit slot 50 such that projectile catchers 28*a* and 28*d* are able to be launched through exit slit 50. Snubber line 54 extends along exit slot 50 such that projectile catchers 28*a* or 28*d* will contact snubber line 54 as the projectiles are launched through exit slot 50.

Figure 8:
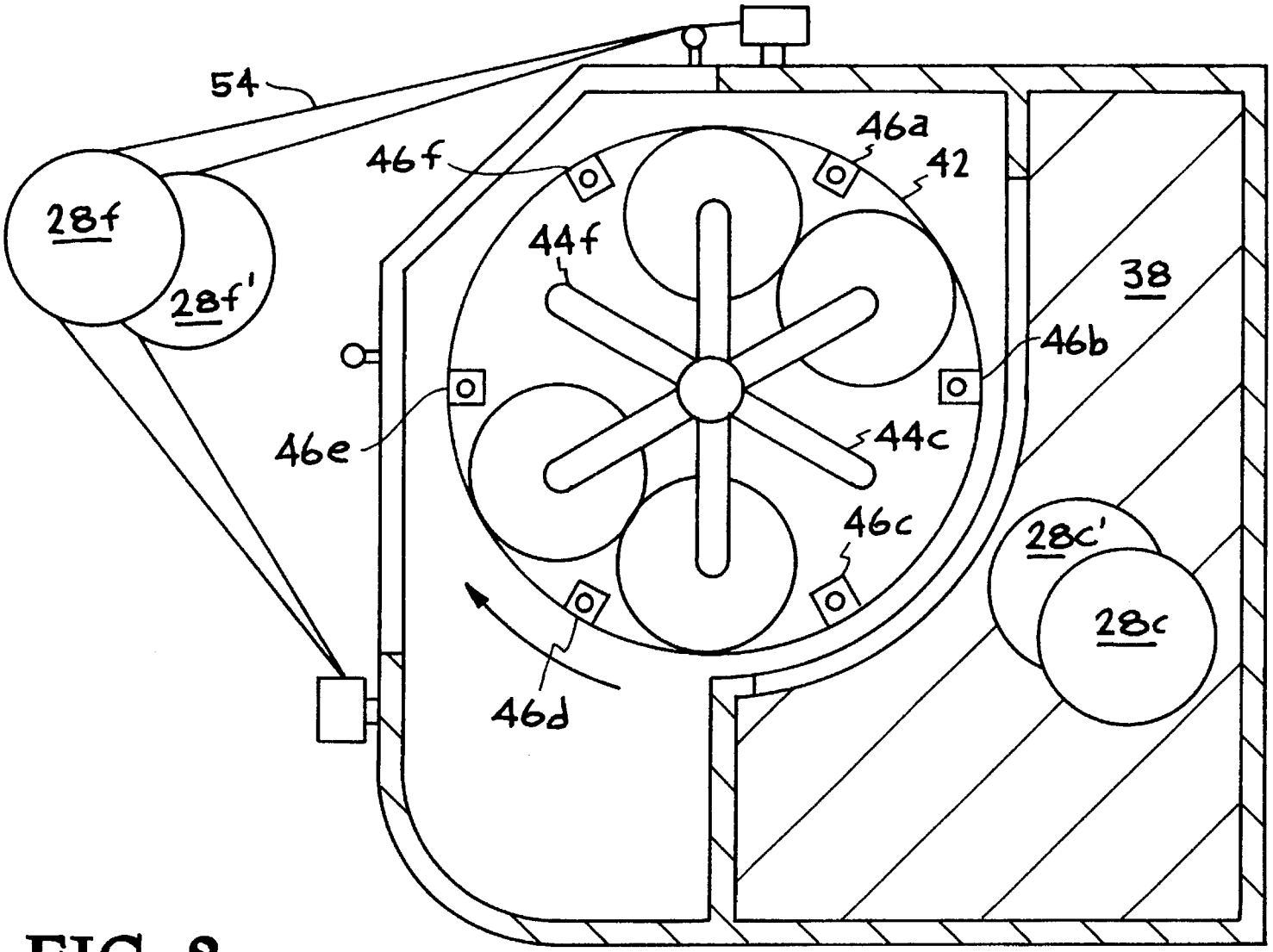
FIG. 8 is a side cut-away view of a projectile intercepting device during the launch of projectile catchers in accordance with the present invention.

Referring now to FIG. 8, a side cut-away view of the present invention during the launch of projectile catchers is shown. The process of launching projectile catchers 28*f* and 28*f'* occurs as follows (28*f'* is a projectile catcher launched from underneath rotator 42). First, the present projectile intercepting device 20 receives information describing the path of an incoming projectile from a projectile tracking system. In the present embodiment, the information includes the time and location where the incoming projectile will intercept a plane of protection provided by the present projectile intercepting device.

Next, controller 40 determines the launch parameters necessary to launch a projectile catcher into the path of the incoming projectile. As described above, in the present embodiment, rotator 42 is rotating at a constant speed of approximately 3370 rpm. Hence, it can be calculated that in the present embodiment, a projectile released from the rotator will have a flight speed of approximately 60 meters per second. By knowing the location where the incoming projectile will intercept the plane of protection, the time at which the incoming projectile will intercept the plane of protection, and the speed of the projectile catcher, controller 40 calculates the required launch parameters for projectile catcher. In the present embodiment, the launch parameters calculated by controller 40 include the time of release and the release angle necessary to launch the projectile catcher through exit slot 50 into the path of the incoming projectile. The angle at which the projectile is released determines the direction and the path the projectile catcher will travel through the plane of protection. The time of release determines when the projectile catcher will be at a given point within the plane of protection. If the projectile catcher is launched too early it will arrive at the intersection point before the projectile. Likewise, if the projectile catcher is launched too late, it will not arrive at the intersection point until after the incoming projectile reached the intersection point. Thus, a very narrow time window exist for launching the projectile catcher.

Controller 40 is electrically coupled to the array of laser diodes 62 of FIG. 6 which is adapted to activate photocells 46*a*–46*f*. Controller 40 turns on a desired laser light source such that a desired photocell is activated. Once the photocell is activated, sets of opposing fingers associated with the photocell are caused to spring open. Thus, in the embodiment of FIG. 8, photocell 46*f* is activated such that opposing fingers 44*f* spring apart. Once fingers 44*f* spring apart, projectile catcher 28*f* is launched through exit slot 50. In the present embodiment, the projectile catchers rotate about their own axis before being launched at the same rate as the ringer assembly, because the ringer arms hold the disk rigidly to the rotor shaft. Therefore, once launched the projectile catchers rotate enough to remain aerodynamically stable. Although spring loaded flinger arms are used in the present embodiment, the present invention is also well suited to the use of other projectile catcher holding means.

Figure 10:
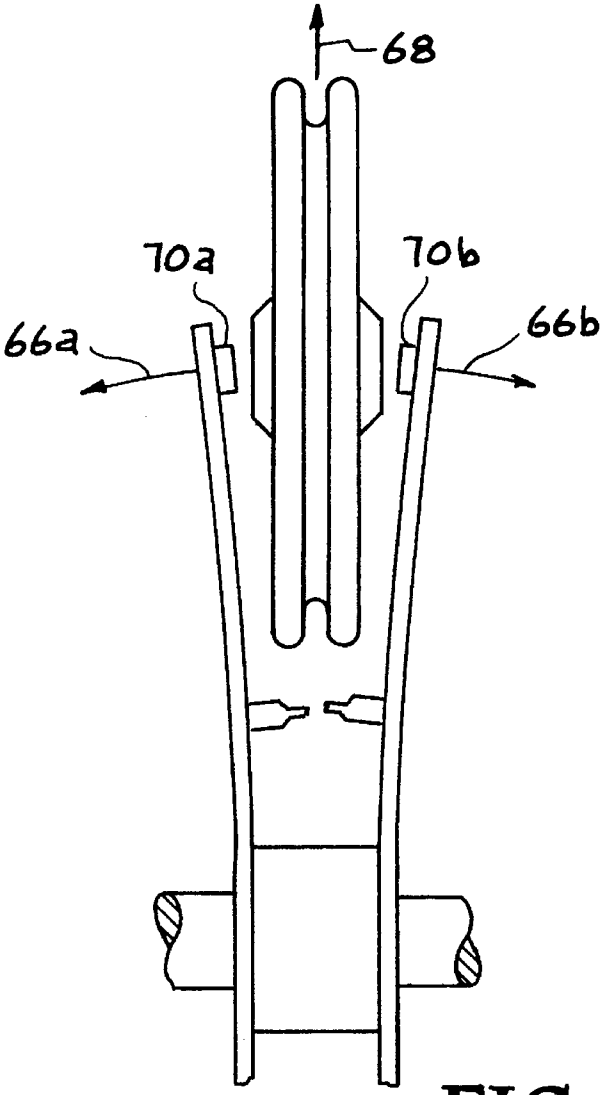
FIG. 10 is diagram illustrating the orientation of a projectile catcher between a set of open opposing fingers in accordance with the present invention.
Figure 9:
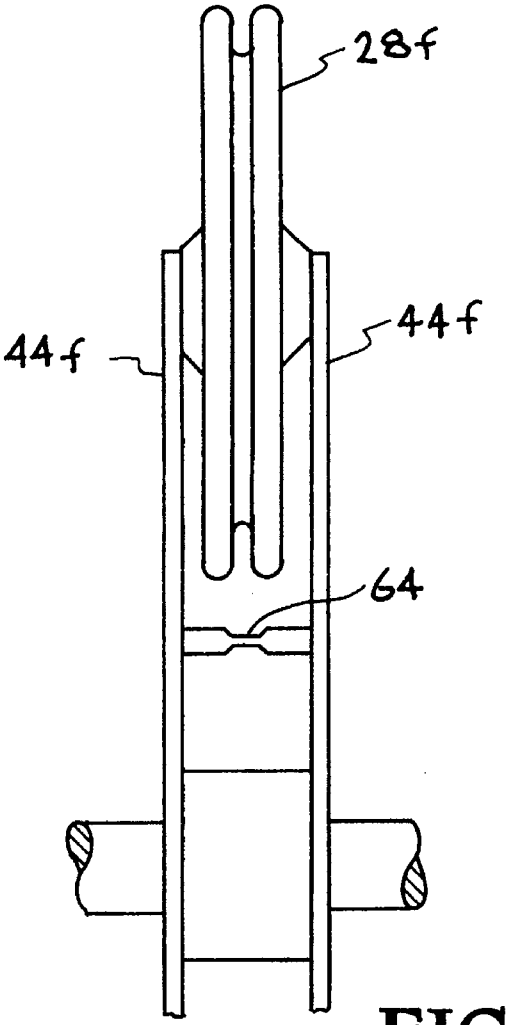
FIG. 9 is diagram illustrating the orientation of a projectile catcher retained between a set of closed opposing fingers in accordance with the present invention.

With reference now to FIG. 9 and 10, diagrams illustrating the orientation of a projectile catcher 28*f* retained between a set 44*f* of opposing fingers. In the present embodiment, set 44*f* of opposing fingers have a spring force which causes the fingers to wish to spring apart. A fusible link 64 holds set 44*f* of opposing fingers together such that projectile catcher 28*f* is retained between set 44*f* of opposing fingers. In the present embodiment, once the photocell is activated, fusible link 64 associated with the activated photocell is broken as shown in FIG. 10. When the fusible link is broken, set 44*f* of opposing fingers spring open as shown by arrows 66*a* and 66*b*, and projectile catcher 28*f* flies forward as shown by arrow 68. Tabs 70*a* and 70*b* on each of the opposing fingers extend into an indentation in projectile catcher 28*f*. In the present embodiment, fusible link 64 is comprised of an electrically detonated primer charge. Once the photocell associated with the fusible link is activated, an electrical charge is sent to fusible link 64 thereby detonating the primer charge. By using a primer charge, an immediate release of projectile catcher 28*f* from between set 44*f* of opposing fingers is insured. Although such a fusible link is used in the present embodiment, the present is well suited to numerous other techniques for holding sets of opposing fingers together. Likewise, the present invention is also well suited to using only one finger to retain the projectile catcher.

Figure 11:
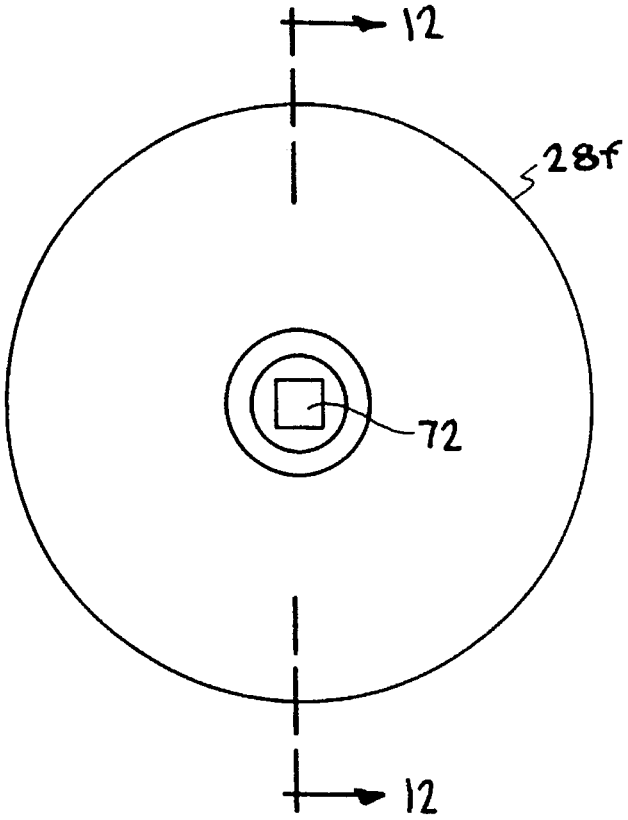
FIG. 11 is a side view of a projectile catcher in accordance with the present invention.

Referring next to FIG. 11, a side view of a projectile catcher 28*f* is shown. In the present embodiment, the projectile catchers are discs having an effective diameter of approximately 15 centimeters. The disks are comprised of $B_4C$-Al cermet (ceramic-metal composite) core having sufficient thickness to stop a high-powered (e.g. a .300 Wby Magnum equivalent) bullet. The cermet core is surrounded by a Kevlar-composite jacketing. Once a projectile, such as a bullet, strikes the disc, debris from the bullet is within the Kevlar-composite jacketing. Thus, the projectile catcher with the projectile embedded therein comes to rest after the projectile catcher intercepts the incoming projectile. As a result, the targeted victim is protected from the projectile and any debris such as projectile fragments. The projectile catchers of the present invention further include an indentation 72 for receiving tabs 70*a* and 70*b* on the opposing fingers. The present invention is also well suited to using disks having a larger or smaller diameter, to projectile catchers which are not disk-shaped, and to using projectile catchers formed of material other than a Kevlar encased cermet core.

Figure 12:
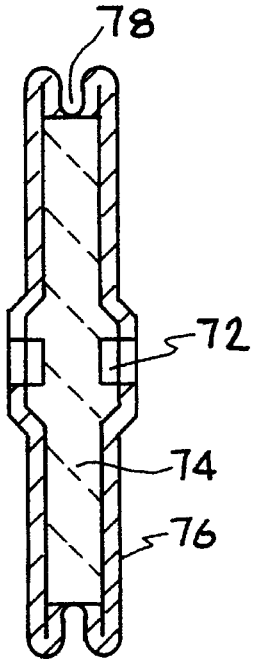
FIG. 12 is a front cut away view of the projectile catcher of FIG. 11 in accordance with the present invention.

Referring next to FIG. 12, a front cut-away view of a projectile catcher of the present invention taken along line 12—12 is shown. As mentioned above, the present projectile catcher is comprised of a $B_4C$-Al cermet (ceramic-metal composite) core 74 surrounded by a Kevlar-composite jacketing 76. Additionally, in the present embodiment, the projectile catcher has a groove 78 formed along the periphery thereof. Groove 78 is adapted to receive snubber line therein once the projectile is launched from the present projectile intercepting device 20. In the present embodiment, the projectile catchers have sufficient mass to intercept an incoming projectile without being deflected into the targeted victim. For example, in the present embodiment, the projectile catcher has a mass of 7400 grains and is traveling at 60 meters per second. A typical bullet has a mass of 180 grains and travels at approximately 900 meters per second. If the bullet is traveling perpendicular to the projectile catcher just prior to collision, the projectile with the bullet embedded therein will be deflected by only approximately 21 degrees. Such a deflection angle is taken into consideration when selecting the location and orientation of the present projectile intercepting device with respect to the targeted victim so that the snubber line can hold the disk and prevent it from flying of in an uncontrolled path.

With reference again to FIG. 8, in the present embodiment, two projectile catchers 28*f* and 28*f'* are launched from the projectile intercepting device 20. Projectile catcher 28*f'* is a launched from underneath rotator 42 at the same release angle as projectile catcher 28*f*, but slightly later than when projectile catcher 28*f* was released. In so doing, projectile catchers 28*f* and 28*f'* slightly overlap each other as they both fly to the location where the incoming projectile intersects the plane of protection provided by the present invention. The overlapping orientation of projectile catchers 28*f* and 28*f'* insures that incoming projectile is intercepted by at least one projectile catcher. In the present embodiment, projectile catchers 28*f* and 28*f'* are launched such that the incoming projectile strikes the overlapped portion of projectile catchers 28*a* and 28*a'*.

Figure 13:
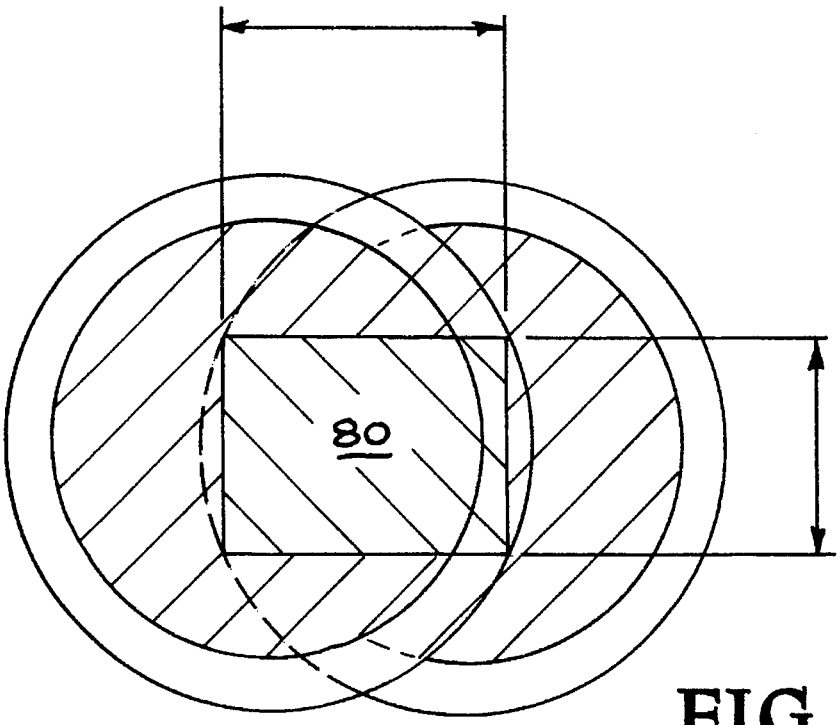
FIG. 13 is a diagram illustrating two overlapping projectile catchers in accordance with the present invention.

With reference now to FIG. 13, a diagram illustrating two overlapping projectile catchers is shown. In the present embodiment, the projectile catchers are launched such that the incoming projectile strikes the overlapping projectile within region 80. In so doing, the present projectile intercepting device remains effective even when slight projectile launch errors exist.

With reference once again to FIG. 8, in the present embodiment, for each projectile catcher that is launched, a projectile catcher positioned diametrically opposite the launched projectile catcher is ejected into dump region 38. Dump region 38 is comprised of a crushable impact absorbing material. By dumping oppositely positioned projectile catchers 28*c* and 28*c'*, rotator 42 remains balanced after the launch of projectile catchers 28*f* and 28*f'* (28*c'* is a projectile catcher previously disposed underneath rotator 42). Although a dump region is used in the present embodiment, the present invention is also well suited to being used without a dump region.

Each of projectile catchers 28*f* and 28*f* engage snubber line as they are launched through exit slot 54. Projectile catcher 28*f* engages snubber line 54, while projectile catcher 28*f'* engages snubber line 54' (snubber line 54' was disposed behind snubber line 54 in FIG. 5). The snubber line is used to restrict the path of the projectile catchers after interception of the incoming projectile. In an embodiment where more than two sets of snubber line spools are used, each snubber line is spaced apart from the adjacent snubber line. In addition, in such an embodiment, the projectile catchers are axially staggered on rotator 42 such that every projectile catcher launched through exit slot 50 engages a different snubber line. Thus, when multiple projectile catchers are launched from the present projectile intercepting device, each projectile has a snubber line associated therewith.

Although the present embodiment describes the use of two sets of opposing fingers, projectile catchers, light sensors, and light sources, the present invention is also well suited to using only a single set of opposing fingers, projectile catchers, light sensors, and light sources, within the projectile intercepting device. However, by using two sets of opposing fingers, catchers, light sensors, and light sources, an additional degree of reliability is added to the present invention.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

We claim:

1. An device for intercepting a projectile comprising:

a projectile path receiver receiving data indicative of the path of a projectile;

a flinger mechanism coupled to a projectile catcher, said flinger mechanism for launching said projectile catcher therefrom; and a projectile catcher release controller coupled to said flinger for controlling launch parameters of said projectile catcher such that said flinger launches said projectile catcher into said path of said projectile.

2. The projectile intercepting device of claim 1 wherein said flinger mechanism launches said projectile catcher into the path of a bullet.

3. The projectile intercepting device of claim 1 wherein said flinger mechanism is coupled to a plurality of projectile catchers.

4. The projectile intercepting device of claim 3 wherein said flinger mechanism is adapted for concurrently launching a plurality of said projectile catchers into said path of said projectile.

5. The projectile intercepting device of claim 4 wherein said concurrently launched plurality of said projectile catchers overlap at least a portion of each other when said plurality of said projectile catchers intercept said path of projectile such that said overlapping portion of said projectile catchers intercepts said projectile.

6. The projectile intercepting device of claim 1 further comprising:

a snubber line coupled to said ringer for restricting the distance traveled by said projectile catcher after said projectile catcher is launched from said flinger.

7. The projectile intercepting device of claim 1 wherein said flinger mechanism further comprises:

a rotator having said projectile catcher coupled thereto, said rotator rotating such that said projectile catcher is launched outwardly from said flinger once said projectile catcher is released from said rotator.

8. The projectile intercepting device of claim 7 wherein said flinger mechanism further comprises:

a light sensor disposed on said rotator for causing said projectile catcher to be released from said rotator when said light sensor is activated; and a light source disposed to activate said light sensor such that said projectile catcher is released from said rotator.

9. The projectile intercepting device of claim 7 wherein said flinger mechanism further comprises:

opposing fingers coupled to said rotator, said opposing fingers retaining said projectile catcher therebetween.

10. A method for intercepting a projectile comprising the steps of:

receiving data indicative of a path of a projectile;

calculating launch parameters required to launch a projectile catcher into said path of said projectile;

launching said projectile catcher from a flinger mechanism into said path of said projectile using said calculated launch parameters;

limiting the distance traveled by said projectile catcher after said projectile catcher is launched from said flinger.

11. The method for intercepting a projectile as recited in claim 10 wherein said step of receiving data indicative of a path of a projectile further comprises the step of:

receiving data indicative of a path of a bullet.

12. The method for intercepting a projectile as recited in claim 10 wherein said step of launching said projectile catcher from a flinger mechanism further comprises the step of:

launching a plurality of said projectile catchers from said flinger into said path of said projectile.

13. The method for intercepting a projectile as recited in claim 12 wherein said step of launching a plurality of said projectile catchers from said flinger into said path of said projectile further comprises the step of:

concurrently launching a plurality of said projectile catchers into said path of said projectile.

14. The method for intercepting a projectile as recited in claim 13 wherein said step of concurrently launching a plurality of said projectile catchers into said path of said projectile further comprises the step of:

concurrently launching said plurality of said projectile catchers with at least a portion of each of said plurality of said projectile catchers overlapping each other such that said overlapping portion of said projectile catchers intercepts said projectile.

15. The method for intercepting a projectile as recited in claim 10 wherein said step of limiting the distance traveled by said projectile catcher after said projectile catcher is launched from said flinger further comprises the step of:

using a snubber line coupled to said flinger to limit the distance traveled by said projectile catcher after said projectile catcher is launched from said flinger.

16. The method for intercepting a projectile as recited in claim 10 wherein said step of launching said projectile catcher from a flinger mechanism further comprises the step of:

releasing said projectile catcher from a rotator such that said projectile catcher is launched outwardly from said flinger once said projectile catcher is released from said rotator.

17. The method for intercepting a projectile as recited in claim 16 wherein said step of releasing said projectile catcher from a rotator further comprises the step of:

disposing a light sensor on said rotator for causing said projectile catcher to be released from said rotator when said light sensor is activated; and activating said light sensor by shining a light thereon such that said projectile catcher is released from said rotator.

18. A bullet intercepting system comprising:

a bullet path receiver for receiving data indicative of the path of a bullet;

a flinger mechanism coupled to a bullet catcher, said flinger mechanism for launching said bullet catcher into said path of said bullet; said flinger mechanism further comprising:

a rotator having said bullet catcher coupled thereto, said rotator rotating such that said bullet catcher is launched outwardly from said flinger once said bullet catcher is released from said rotator;

a light sensor disposed on said rotator for causing said bullet catcher to be released from said rotator when said light sensor is activated; and a light source disposed to activate said light sensor such that said bullet catcher is released from said rotator;

a bullet catcher release controller coupled to said flinger for controlling launch parameters of said bullet catcher such that said flinger launches said bullet catcher into said path of said bullet; and a snubber line coupled to said flinger for restricting the distance traveled by said bullet catcher after said bullet catcher is launched from said flinger.

19. The bullet intercepting system of claim 18 wherein said flinger mechanism is adapted for concurrently launching a plurality of said bullet catchers into said path of said bullet.

20. The bullet intercepting system of claim 19 wherein said concurrently launched plurality of said bullet catchers overlap at least a portion of each other when said plurality of said bullet catchers intercept said path of bullet such that said overlapping portion of said bullet catchers intercepts said bullet.

* * * * *